US008197307B1

(12) United States Patent
Luna et al.

(10) Patent No.: US 8,197,307 B1
(45) Date of Patent: Jun. 12, 2012

(54) SURFACE POLISHING SYSTEM

(76) Inventors: Kenneth Luna, Santa Ana, CA (US); Elsie A. Jordan, Temecula, CA (US)

( * ) Notice: Subject to any disclaimer, the term of this patent is extended or adjusted under 35 U.S.C. 154(b) by 511 days.

(21) Appl. No.: 12/383,039

(22) Filed: Mar. 19, 2009

(51) Int. Cl.
*B24B 7/00* (2006.01)

(52) U.S. Cl. ..... 451/159; 451/357; 51/307; 51/309

(58) Field of Classification Search ..... 451/121, 451/159, 163, 165, 357; 51/307, 309
See application file for complete search history.

(56) References Cited

U.S. PATENT DOCUMENTS

| | | | | |
|---|---|---|---|---|
| 3,779,887 | A * | 12/1973 | Gildone | 204/224 R |
| 4,536,911 | A * | 8/1985 | Demetriades | 15/230.12 |
| RE32,978 | E * | 7/1989 | Demetriades | 15/230.12 |
| 4,962,562 | A * | 10/1990 | Englund et al. | 15/230.16 |
| RE35,021 | E * | 8/1995 | Englund et al. | 15/230.16 |
| 5,693,239 | A * | 12/1997 | Wang et al. | 216/88 |
| 2005/0155515 | A1 | 7/2005 | Jordan et al. | |
| 2005/0223512 | A1* | 10/2005 | Mangold et al. | 15/229.14 |
| 2007/0209549 | A1* | 9/2007 | Hasinovic et al. | 106/11 |
| 2007/0221089 | A1 | 9/2007 | Hasinovic et al. | |
| 2008/0127856 | A1 | 6/2008 | Hasinovic | |
| 2008/0171493 | A1* | 7/2008 | Feng et al. | 451/59 |

OTHER PUBLICATIONS

"How Aluminum is Made", internet document, May 16, 1999.*
"Aluminum Oxide" internet document, Aug. 11, 2011.*

* cited by examiner

*Primary Examiner* — Maurina Rachuba
(74) *Attorney, Agent, or Firm* — Maria Erlinda Co Sarno

(57) ABSTRACT

A surface polishing system leaving a surface free from streaks and swirls after the application of a polishing composition into a painted metallic surface includes a polish applicator having a vibrating motion attached to a pad assembly covered with a supersoft 100% polyester material and a polishing composition of 15-30% by weight of high purity aluminum oxide having a particle size of no greater than 0.3 micron or 300 nanometer and 3-20% by weight of calcined alumina comprising at least 70% α-aluminum oxide (Al2O3) with a low calcination degree and a primary crystal size of less than 1 micron, the combined high purity aluminum oxide and calcined alumina having a total concentration of 30-40% by weight of the polishing composition.

18 Claims, 4 Drawing Sheets

SURFACE POLISHING SYSTEM

This invention relates to a polishing and smoothing composition which when applied on a painted metallic surface with a device using an applicator pad covered with a 100% supersoft polyester material, produces a surface free from fine swirls or streaks even when the surface is exposed to the sun.

BACKGROUND

There are so many surface treatment compositions and devices in the market to clean, protect and polish a painted metallic body surface, most commonly encountered in vehicles. These are usually classified as cleaners, coating materials, polishers and smoothers. Cleaners remove dirt and deposits from the surface; coating materials are usually waxes, silicone resins that adhere to the surface to protect the surface from damage and prevent dirt and other deposits from sticking into the surface; polishers are usually those with abrasives to remove dirt and other deposits that can not be removed by cleaning; and, smoothers are those with mild abrasives that reduce the number or severity of surface imperfections in the surface coating such as swirl marks, fine streaks and 'spider-webs', collectively referred to herein as fine streaks and swirls. Conventional commercial polishes typically contain a detergent dispersed in water or dissolved in a solvent, often together with abrasives for dry application to a metal surface such as the surface of a car or other vehicles such as trucks, vans, buses, trains, boats, motorcycles, snowmobiles, trailers and the like. Some polishing compounds such as those known as cleaner polishers are formulated with abrasive materials such as aluminum oxide with a particle size of less than 300 nanometer to enhance its cleaning properties and produce a high gloss finish. After application, the dried polish is usually removed by hand or by buffing machines which are heavy, hard to operate, and time consuming. Buffing is technique dependent and buffing machines usually heat the surface especially at high rotational speed during the application which can damage the painted surface. Consequently, surface treating compositions that will not need the use of buffing machines are desirable.

Many surface treatment compositions claim to be a smoothing composition because these leave a surface free from fine streaks and swirls after the application. These fine streaks and swirls, however, are still there. They are just undetectable when the surface is in a covered or shaded area. These fine streaks and swirls that are undetectable, become apparent when the surface is exposed under the sun because they are reflected by its rays.

It is therefore an object of this invention to provide a surface polishing system that do not leave fine streaks and swirls on a painted metallic surface.

It is also an object of this invention to provide a polishing and smoothing composition that can be applied without the need of a buffing machine.

SUMMARY OF THE INVENTION

This invention relates to a surface polishing system that do not leave fine streaks and swirls on a painted metallic surface after the application of a polishing composition into the surface. The surface polishing system comprises a polish applicator having a vibrating motion attached to a pad assembly covered or lined with a supersoft 100% polyester material, the pad assembly comprising a pad and a means to attach the pad to the applicator; and, a polishing composition of 15-30% by weight of high purity aluminum oxide having a particle size of no greater than 0.3 micron or 300 nanometer and 3-20% by weight of calcined alumina comprising at least 70% α-aluminum oxide (Al2O3) with a low calcination degree and a primary crystal size of less than 1 micron, the combined high purity aluminum oxide and calcined alumina having a total concentration of 30-40% by weight of the polishing composition.

A readily available polish applicator having a vibrating motion is the orbital sander. The orbital sander, however, also has a rotating motion along with the vibrating motion. The pad assembly is attached to the head of the polish applicator and for water based polishing compositions, a non-water and non-reactive absorbent pad is used. For polishing compositions that are organic solvent based, the recommended pad is one that is non-reactive, non-absorbent and not soluble with the solvent. Because the polishing and smoothing composition is liquid, an absorbent pad tends to absorb the polishing composition before it becomes available at the cover for polishing a painted metallic surface. The supersoft 100% polyester cover can also be lined with a plastic frame so that it does not matter whether the pad is absorbent or not. The supersoft 100% polyester cover can be designed as a removable sleeve which can surround the pad. However, a cover wherein the entire inner surface of the supersoft 100% polyester is attached to one side of the pad assembly, the side facing the inner surface of the cover, will perform better. The supersoft 100% polyester comprises a pile of packed fine supersoft fibrous filaments having a thickness of approximately 0.00013 to 0.0003 inches and a length of approximately 0.1 to 0.16 inches.

The example of a polishing and smoothing composition, given is water based but the claimed formulation can also be applied to hydrocarbon solvent based formulations. The high purity aluminum oxide is sold as UFX-MAR and the calcined alumina is sold as P10 FEINST. The FEINST scale is used to denote calcination degree. The P10 in the FEINST scale denotes the calcination degree in the FEINST scale. Aside from the high purity aluminum oxide and the calcined alumina, the formulation usually has other ingredients like a suspending agent, a silicone emulsion, a gloss enhancing agent, a hydrocarbon solvent and water. The suspending agent is a hydroxypropyl methylcellulose product at a concentration of 0.2-1%, the silicone emulsion is an emulsified silicone oil comprising 60% active non-ionic emulsion formulated with a polydimethylsiloxane at a concentration of 5-30%, the gloss enhancing agent consisting of linear non-reactive polydimethylsiloxane is at a concentration of 1-8%, and the hydrocarbon solvent is an aliphatic hydrocarbon at a concentration of 5-10%. Other ingredients may be further added to the above formulation such as a wax emulsion at a concentration of 2-15%, a water repellent film former at a concentration of 0.5 to 5%, an additional gloss agent at a concentration of 0.1 to 1% and preservatives, fragrances and colorants in effective amounts of less than 1%.

The detailed description represented herein is not intended to represent the only way or the only embodiment in which the claimed invention may be practiced. The description herein is provided merely as an example or examples or illustrations of the claimed invention and should not be construed as the only way or as preferred or advantageous over other embodiments or means of practicing the invention. A vibrator achieving the same degree of vibration as that obtained from commercially available orbital sanders can be substituted to the orbiter used herein and is within the scope of this invention. Likewise, other soft polyester materials having a pile made of closely packed supersoft fibrous fine filaments having similar diameter/thickness and length as the polyester material used herein is also within the scope of this invention. Also, while a water based polishing and smoothing composition is illustrated here as example, a solvent based polishing and smoothing composition having the same ranges of concentration for the high purity alumina and the calcined polishing alumina is also within the scope of this invention. The detailed description includes specific details to provide a thorough understanding of the claimed invention and it is apparent to those skilled in the art that the claimed invention may be practiced without these specific details. In some instances, well known structures and devices are shown in block diagrams or drawn with broken lines in order to avoid obscuring the main concepts of the invention.

BRIEF DESCRIPTION OF THE DRAWING

Aspects of the present invention are illustrated by way of example, and not by way of limitation, in the accompanying drawings, wherein.

DETAILED DESCRIPTION OF THE INVENTION

A surface is typically cleaned by conventional washing before it is polished. A protective coating such as wax with or without a polish is applied to the dried surface and then buffed to remove excess wax or polish and to give a gloss on the surface. Buffing machines are usually heavy, hard to operate, and emits heat during usage resulting from its high rotational speed. Heat from the buffing machine have or can cause damage on the surface especially on the paint.

Figure 1:
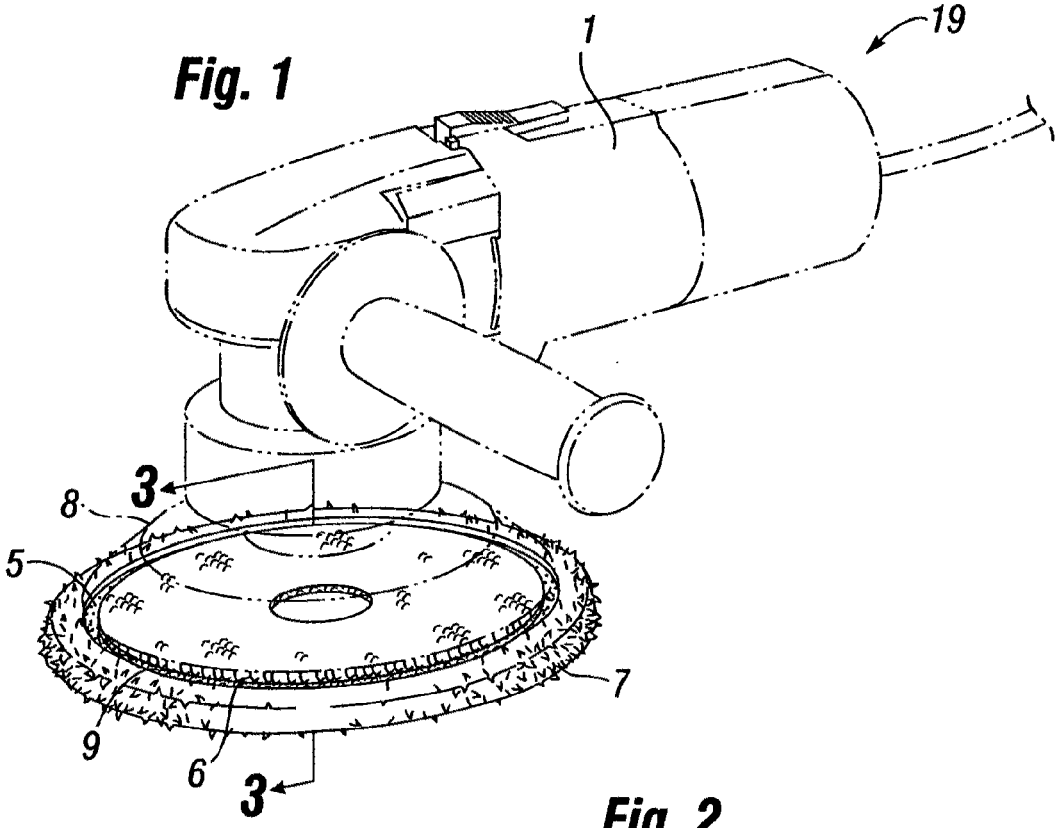
FIG. 1 is a perspective view of an orbital sander with a pad assembly having a thin non-absorbent pad covered with a supersoft 100% polyester material.
Figure 2:
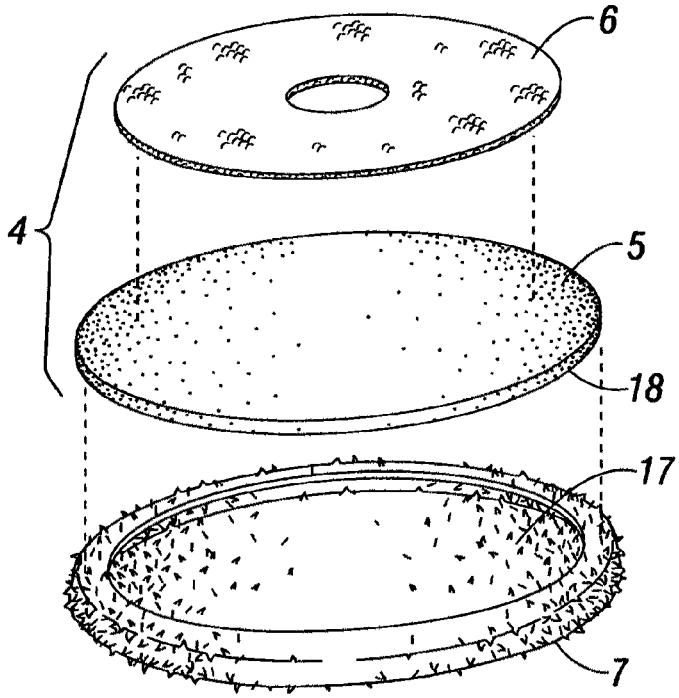
FIG. 2 is an exploded view of a pad assembly having a non-absorbent pad lined or covered with supersoft 100% polyester material.

The polishing system proposed here uses an orbital sander 1 instead of a buffing machine which are lighter and easy to operate even by a novice. They are either electric or air-driven. Examples of suitable orbital sanders are the Industrial Pneumatic Speed Sander Pro-finisher sold by Hutchins Manufacturing Company, Pasadena, Calif. and the double insulated random orbit polisher sold by Porter-Cable Corporation, Jackson, Tenn. There are other types of orbital sanders. They are hereinafter collectively referred to as orbiter 1. Orbital sanders have a dual action, it vibrates as it revolves. The orbital sanders are used here because of its vibrating action. A machine or device that vibrates without rotation, a vibrating applicator that would accommodate a pad assembly, would be as efficient if not more in polishing the surface using the polishing and smoothing composition described herein than an orbital sander. However, the orbital sanders or orbiter 1 are more commercially accessible. These orbiters 1 are usually installed with a buffer pad assembly 2 sold by Meguiar's Inc., Irvine Calif., disclosed by U.S. Pat. No. 5,123,139 which is incorporated herein by reference. Other buffing pad assemblies that can fit into the orbiters can also be used. Also, while a hook and loop means for attaching the pad assembly to the orbiter is described here, other method of attachments can be used by either the pad assembly or the orbiter. With the orbiters identified above as examples, the buffer pad assembly 2 attaches to the orbiter 1 on one side 3 of the buffer pad assembly 2 through a hook and loop engagement. A pad assembly 4 comprising of a non-water absorbent and non-reactive pad 5 such as a neoprene pad attached to a hook and loop layer 6 has been designed for a water based polishing and smoothing composition as shown in FIGS. 1 and 2. If the polishing composition is organic solvent based, the pad should be one that would not react, absorb or dissolve into the solvent. These non-absorbent, non-reactive and insoluble pads are collectively referred to herein as non-absorbent pad. It is a requirement that both buffer pad assembly 2 and pad assembly 4 have an outer lining or a cover 7 made with a supersoft 100% polyester material such as that commercially distributed by Berkshire Blanket, 44 E. Main St., Ware, Mass. 01082 and sold by retail stores like Bed, Bath and Beyond and Sears Company, as BERKSHIRE BLANKET®, sablesoft throw in order to prevent the formation of fine streaks and swirls when used in combination with the polishing and smoothing composition described herein. The supersoft 100% polyester material is hereinafter also simply referred to as polyester or polyester material. The outer lining or cover 7 also simply referred to as cover 7 is placed at the side opposite the hook and loop surface 3 or 6. The hook and loop surface is the side that attaches to the head 8 of the orbiter 1 which also has a hook and loop 9 surface at its outside surface to engage with the hook and loop surface 3 or 6 of the pad assemblies.

Figure 1A:
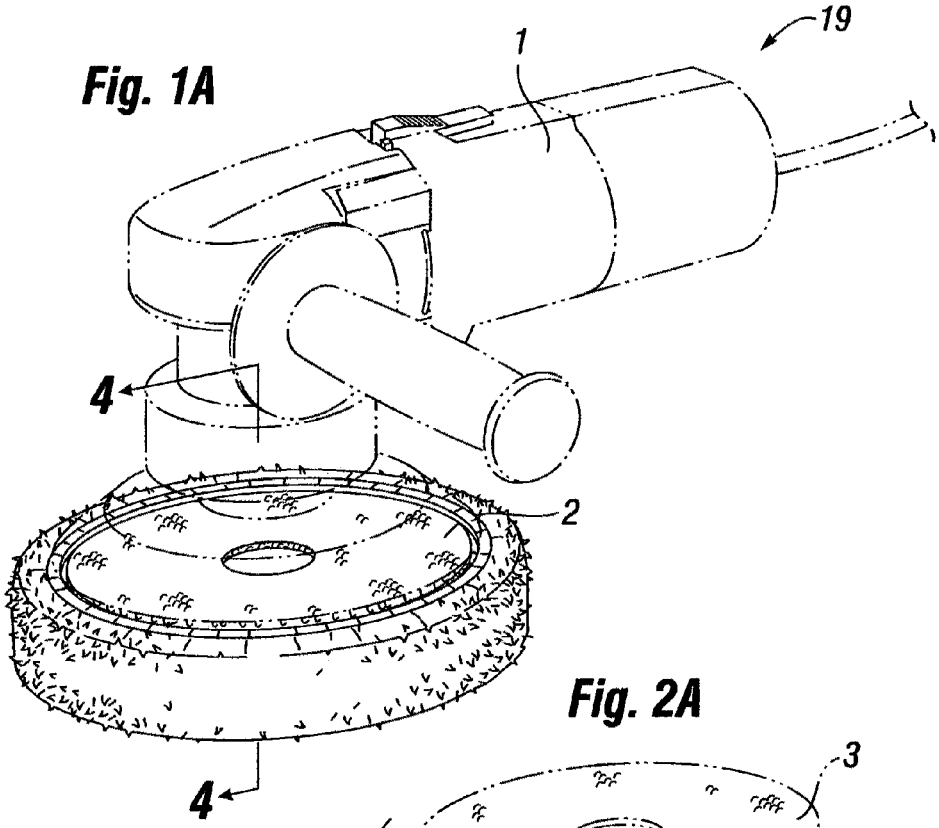
FIG. 1A is a perspective view of an orbital sander with a prior art commercially available pad assembly covered with a supersoft 100% polyester material.
Figure 2A:
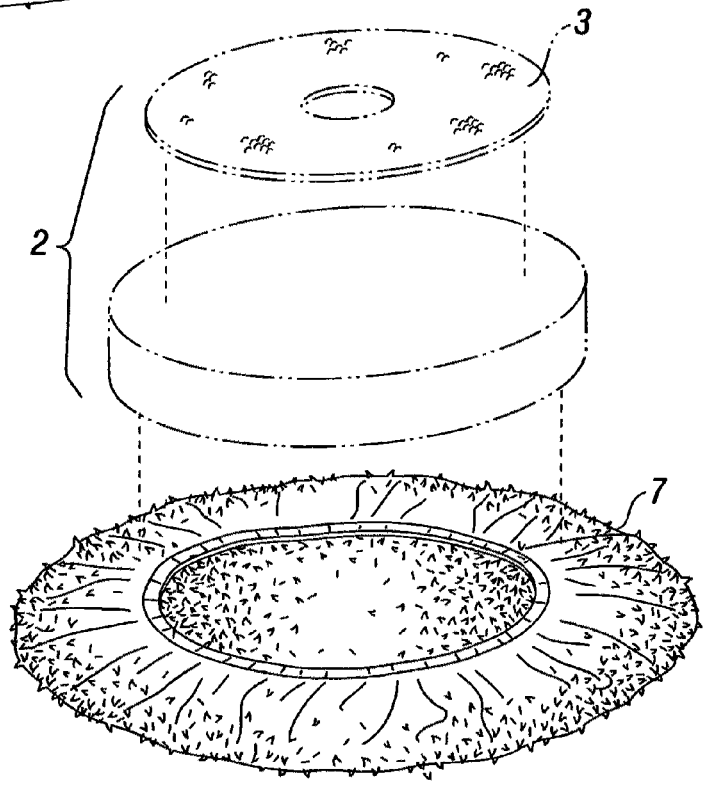
FIG. 2A is an exploded view of a pad assembly having a commercially available absorbent pad lined or covered with supersoft 100% polyester material.
Figure 1B:
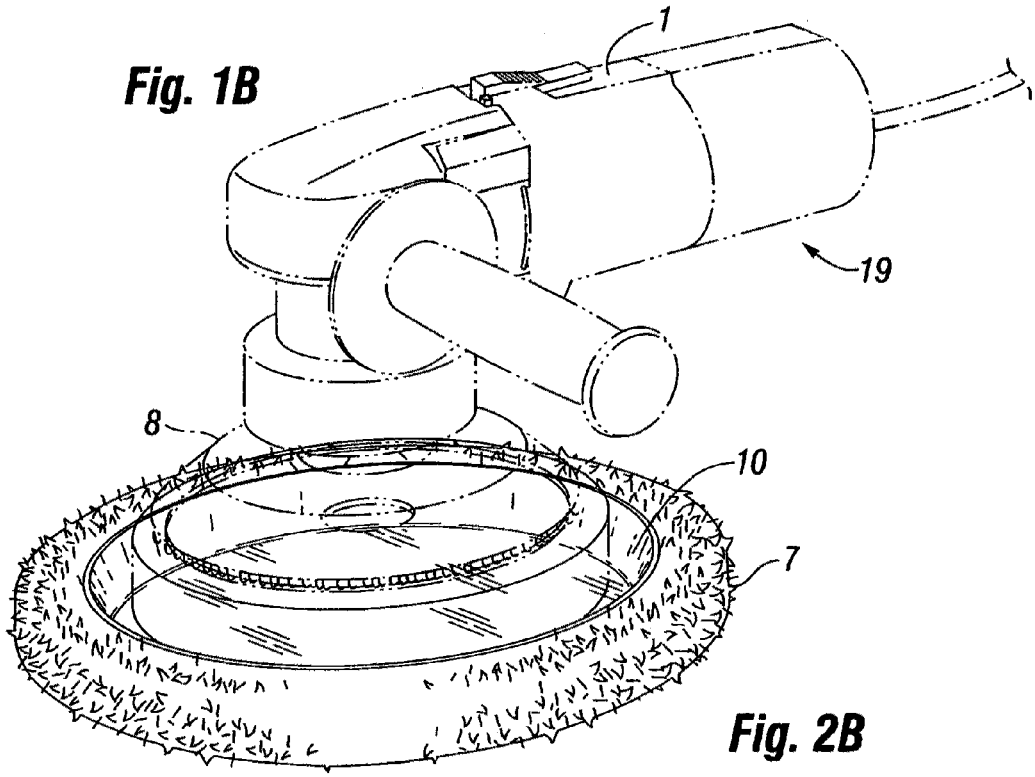
FIG. 1B is a perspective view of an orbital sander with a prior art commercially available absorbent pad assembly rendered less accessible to liquids by lining the supersoft 100% polyester material with a plastic frame.
Figure 2B:
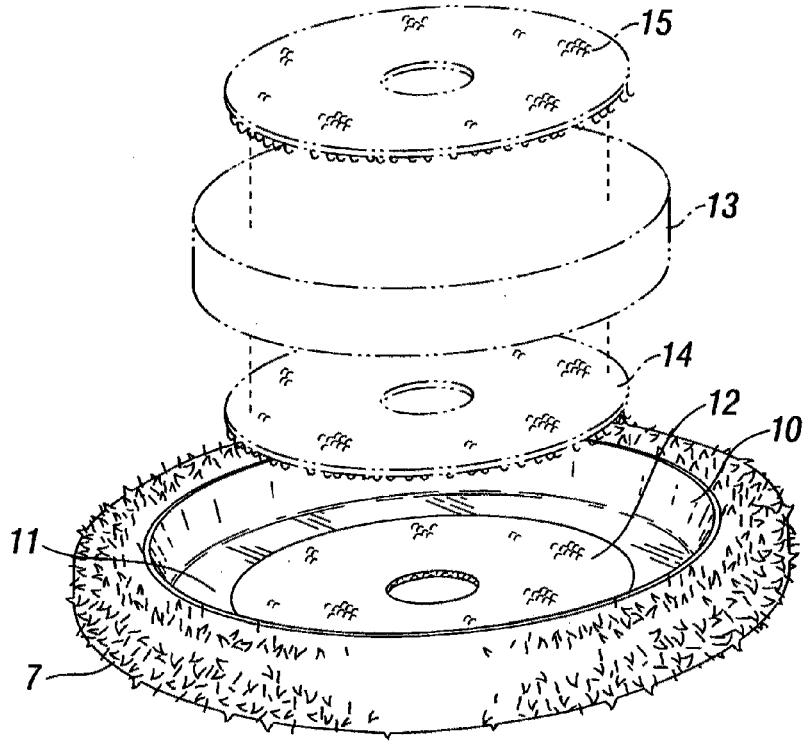
FIG. 2B is an exploded view of a pad assembly having a commercially available absorbent pad with the supersoft 100% polyester material cover lined with a plastic frame.

FIG. 2 shows the exploded view of the pad assembly 4 with the polyester cover 7 while FIG. 2A shows the exploded view of the pad assembly having the polyester cover 7 but using a commercially available buffer pad assembly 2. FIG. 1A is a perspective view of a commercial orbital sander or orbiter 1 using a commercial buffer pad assembly 2 with the polyester cover 7 while FIG. 1 is a perspective view of a commercial orbital sander or orbiter 1 using the pad assembly 4 with cover 7. Although the pad assemblies can be of any thickness, pad assembly 4 is shown here to be thinner than buffer pad assembly 2 which is commercially available. In the use of the buffer pad assembly 2 that have an absorbent pad like those of MEGUIAR'S which are made of foam, it was observed that when the polishing and smoothing composition is applied to the cover 7 for polishing the surface, unnecessary amount of the polishing and smoothing composition are consumed because the polishing and smoothing composition first penetrates and gets absorbed by the buffer pad assembly and only after this surface is wetted does the polishing and smoothing composition wet the cover 7 for application to the surface. A thinner buffer pad assembly is therefore desirable. Further, a non-water absorbent and non-reactive pad such as neoprene is desirable for water based polishing compositions over an absorbent pad because it will not absorb so much of the polishing and smoothing composition. Consequently, most of the applied polishing and smoothing composition will stay at the surface of the cover 7 and be available for polishing the surface. Another way to be able to use an absorbent pad assembly is by attaching or lining cover 7 with a plastic frame 10, recommended to be rigid for ease of handling, to shield the absorbent pad from the polishing and smoothing composition as shown in FIGS. 1B and 2B. With this type of pad assembly, the inner layer 11 of the plastic frame 10 will have a hook and loop layer 12 and the pad 13 to which it attaches to will have a hook and loop layer on both sides, one side 14 attaching to the hook and loop layer 12 of the covered plastic frame and the other side 15 engaging with the hook and loop layer 9 on the head 8 of the orbiter 1. FIG. 1B is a perspective view of a commercial orbiter 1 using the pad assembly described above and shown in FIG. 2B.

Figure 3:
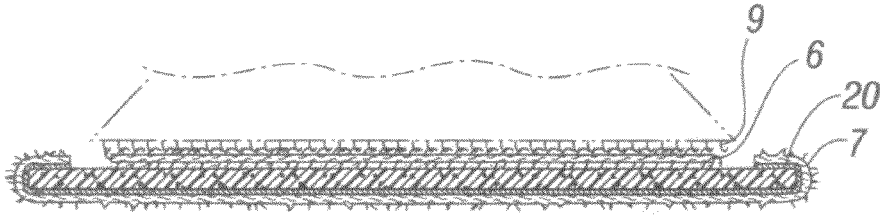
FIG. 3 is a cross sectional view taken at 3-3 of FIG. 1 of a supersoft 100% polyester cover attached to a pad of a pad assembly by a layer of adhesive.
Figure 4:
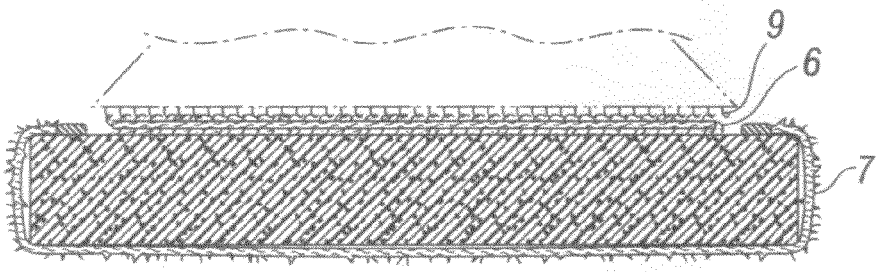
FIG. 4 is a cross sectional view taken at 4-4 of FIG. 1A of a supersoft 100% polyester cover surrounding a pad assembly.

Another important desirable feature is the bonding between the pad assembly and the cover layer. If the cover 7 is just applied to envelope or surround the pad assemblies as a removable sleeve 16 as shown in FIG. 2A, during the polishing process, as the orbiter vibrates and revolves, the cover 7 will not have as steady and firm contact to the surface because the inner surface 17 if the cover is not entirely attached to the pad. During rotation, specially, the cover is free to shift from or with the pad. It is therefore recommended to attach the entire inside surface 17 of the cover 7 to the surface 18 of the pad facing the inside surface of the cover. Since there are different pad materials that can be used, the type of adhesive may differ. For example an adhesive that binds the polyester cover 7 to a foam material may be different from the adhesive that will bind the polyester to the neoprene material. A permanent binding, one that will not detach the cover from the pad assembly even after exposure to the polishing and smoothing composition is recommended for the same reason as stated above, to keep the contact of the cover 7 firm and steady with the surface during the polishing process. Consequently, the adhesive should not react with or dissolve into the solvent of the polishing and smoothing composition. There are other means of attaching the inside surface of the cover with one side of the pad assembly such as by the use of the hook and loop engagement technology, that is, putting a hook and loop layer on the pad facing the cover and another hook and loop layer at the inside surface of the cover. Binding through the use of heat is also possible. With the polyester adhered to the pad, as the orbiter 1 vibrates and rotates the pad, the polyester cover rotates and vibrates in unison with the pad thereby resulting in a better polish. Likewise, with this, the entire pad and cover can adopt more easily to the contour of the car. A cross sectional view of the cover attached to the pad by a layer of adhesive 20 is shown in FIG. 3 while the cross sectional view of the cover merely enveloping the pad is shown in FIG. 4.

Figure 5:
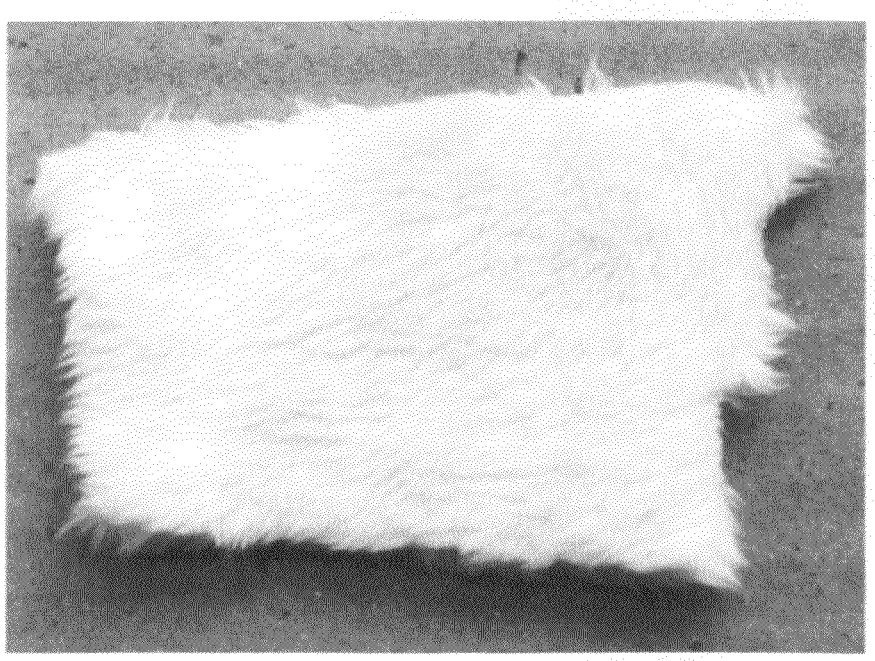
FIG. 5 is a photograph of a supersoft 100% polyester material.

The source of the supersoft 100% polyester material for the cover 7 provides only very little information on the material. FIG. 5 shows a photograph of the polyester material for visualization to be able to differentiate this from other polyester materials. The pile of polyester material is made of fine supersoft polyester filaments. When manually measured by a micrometer, the diameter or thickness of a polyester filament making up the polyester material can range from 0.00013 to 0.0003 inches. The length or height of the polyester filament can range from 0.1 to 0.16 inches. These ranges were obtained by picking at random, one filament at a time, therefore, while a range is given here, these ranges are still an approximation. The filament are closely packed together as best shown by FIG. 5. For contrast, a filament of wool taken at random and measured at the same time as the polyester fiber above, had a diameter or thickness of 0.0006 inches, at least an order of magnitude thicker than the polyester filament.

The orbiter is generally assembled by attaching the hook and loop surface at the head of the orbiter 1 to the hook and loop layer or surface of the pad assembly located opposite the side where the cover 7 is placed or attached. The orbiter 1 assembled with a pad assembly or a polish applicator having a vibrating motion attached to a pad assembly, covered on one side with the supersoft 100% polyester material is hereinafter referred to as applicator 19. The applicator 19 have been used to apply different commercially available wax and polish compositions on a painted metallic surfaces but none of the waxes and polishes tried have prevented the formation or eliminated the presence of fine streaks and swirls. It is probable that there may be a polishing composition that will also not develop or materially reduce the fine streaks and swirls when used with the applicator 19 but this has not been found or identified except for the polishing and smoothing composition described herein. When applicator 19 was used in combination with the polishing and smoothing composition, there were no detectable fine streaks and swirls seen on the polished surface even when the surface was exposed under the sun. Using an applicator covered with a different material other than the polyester material described above with the polishing and smoothing composition herein did not prevent the formation of fine streaks and swirls. The polishing and smoothing composition is hereinafter simply referred to as polishing composition. An example of the polishing composition that exhibits the above property described here is a water based polishing composition. The polishing composition comprises a combination of high purity aluminum oxide also referred to as high purity alumina and a polishing alumina commonly referred to as P10 Feinst or P10 FEINST. An example of high purity alumina suitable for use is UFX-MAR sold by Baikowsi Malakoff Inc., Malakoff, Tex. The high purity aluminum oxide has a particle size of no greater than 0.3 micron or 300 nanometer as measured by a Sedigraph 5100, Micro Meritics Instrument Corporation with a median particle size of 0.23-0.25 micron. Unlike the other polishing composition, a magnesium oxide contaminant will not hurt the performance of the high purity alumina. The polishing alumina commonly referred to as P10 Feinst is a calcined alumina for polishing sold by Almatis, Frankfurt, Germany with a USA office at Leetsdale, Pa. 15056 comprising at least 70% $\alpha$-aluminum oxide ($Al_2O_3$) with a low calcination degree and a primary crystal size of less than 1 micron. This may also be bought and sold by other companies so long as characteristics stated above is the same. The P10 Feinst polishing alumina or calcined alumina having the characteristics described above is hereinafter also referred to simply as polishing alumina. The polishing alumina can range from 3%-20% by weight and the high purity alumina can range from 15%-30% by weight. What is novel is the finding that these two components, the high purity alumina and the polishing alumina, when combined, should have a total concentration of 30%-40% by weight of the composition in order to have a polishing composition that leaves no detectable fine streaks and swirls when used with the applicator 19. The concentrations herein are in percent by weight even if not specifically stated. For example, if the polishing alumina is 5%, the high purity alumina can range from 25-30% but not more even if the sum total is only 35% because the maximum concentration of the high purity alumina is 30% by weight. If the high purity alumina is 15%, the polishing alumina can have a range of 15%-20% but not 25% because the highest workable concentration for the polishing alumina is 20% by weight. An example of a combination at 40% by weight would be 20% polishing alumina and 20% high purity alumina because 20% are within the allowable ranges for both components. The combination of high purity alumina and polishing alumina are usually formulated with a suspending agent, a silicone emulsion, a gloss enhancing agent, a hydrocarbon solvent and water. The above formulation is prepared by predissolving a suspending agent, METHOCEL F4M, in water and adding the rest of the chemicals or components into the METHOCEL solution. METHOCEL F4 M is a hydroxypropyl methylcellulose product sold by Dow Corning, Midland, Mich. METHOCEL F4 is pre-dissolved in water at a concentration of 0.2-1%, before the other ingredients are added to it with mixing. Mixing should be done at high speed until a homogeneous product is obtained. A high shear mixer can be used. There is no particular sequence or order in the addition of the other ingredients into the METHOCEL solution. The METHOCEL keeps the formulation in suspension. However, in case the finished suspension separates into two phases after long standing on storage, simply shake the polishing composition before use.

An emulsified silicone oil comprising of 60% active nonionic emulsion formulated with a polydimethylsiloxane, such as that sold by Dow Corning, Midland, Mich. as DOW CORNING IE 349 EMULSION is added to a final concentration of 5% to 30% by weight. The emulsified silicone oil functions as a lubricant and aid in the spreading characteristic of the composition. Equivalent emulsified silicone oils and silicone emulsions based on high and medium viscosity polydimethylsiloxane can be used. WACKER AK 500 US sold by Wacker Silicones, Adrian, Mich., which consists of four (4) linear non-reactive polydimethylsiloxane is added at a concentration of 1-8% by weight to enhance the gloss on the surface after application. Other dimethylsiloxane fluids of a different grade such as AK 350 and AK 1000 can also be used but AK 500 is a better choice.

An organic solvent such as SHELLSOL D60 sold by Shell Chemicals, Houston, Tex. is added to a final concentration of 5-10% by weight. SHELLSOL D60 is an aliphatic hydrocarbon. This aid in cleaning oily surfaces. Mineral spirits such as SHELLSOL OMS and isoparaffinic solvents can also be used instead of the SHELLSOL D60.

Preservatives, fragrances, fungicides, and dyes or colorants may be added to the polishing composition in effective amounts of less than 1%. Water, preferably soft or deionized water usually ranges from 20-40%.

An example of the above polishing composition is shown in Table I.

TABLE I

| Ingredient | Commercial Name | % by Weight |
|---|---|---|
| High Purity Alumina | UFX MAR | 18 |
| Polishing Alumina | P10 Feinst | 12 |
| Hydroxypropyl Methylcellulose | Methocel F4M | 0.74 |
| Emulsified Silicone Oil | Silicone Emulsion IE 349 | 20 |
| Linear dimethylpolysiloxane | Wacker AK 500 US | 5 |
| Aliphatic hydrocarbon solvent | SHELLSOL D60 | 8 |
| Water (soft or deionized) | | 36.11 |
| Preservative | | 0.15 |

For surfaces with light scratches, a polishing composition with a lower concentration of polishing alumina ranging from 3-8% is alright to use. However, the combined concentration of the high purity alumina and the polishing alumina should still be maintained at a total concentration of 30%-40% by weight of the composition. In this formulation, since the concentration of the polishing alumina is less, the ratio of the polishing alumina to the high purity alumina is different, that is, there is more high purity alumina than polishing alumina in the formulation.

A wax emulsion such as TOMAMINE EMULSION C-340, a Carnauba Wax Emulsion sold by Air Products and Chemicals, Allentown, Pa. in a concentration of 2%-15%; a water repellent film former such as WACKER E 2015 60% Silicone Emulsion in a concentration of 0.5 to 5%; and, an additional gloss agent, WACKER AK 10000 US in a concentration of 0.1-1% can be added to the polishing composition illustrated in Table I for both heavy and light scratches.

An example formulation for the polishing composition with the added ingredients for surfaces with light scratches is shown in Table II.

TABLE II

| Ingredient | Commercial Name | % by Weight |
|---|---|---|
| High Purity Alumina | UFX MAR | 25 |
| Polishing Alumina | P10 Feinst | 5 |
| Hydroxypropyl Methylcellulose | Methocel F4M | 0.6 |
| Emulsified Silicone Oil | Silicone Emulsion IE 349 | 12 |
| Linear dimethylpolysiloxane | Wacker AK 500 US | 3 |
| Linear dimethylpolysiloxane | Wacker AK 10000 US | 0.5 |
| Aliphatic hydrocarbon solvent | SHELLSOL D60 | 8 |
| Wax Emulsion | Tomamaine Emulsion C-340 | 15 |
| Film Former | Wacker E 2015 60% Silicone Emulsion | 1.3 |
| Water (soft or deionized) | | 29.45 |
| Preservative | | 0.15 |

The MSDS (material safety data sheet), certificate of analysis, product brochure and any patents covering the nature and description of the ingredients used here are hereby incorporated by reference.

The polishing composition is applied to a painted metallic surface as follows: a) wash the surface with soap; b) allow the surface to dry; c) apply the polishing composition to the polyester outer lining or cover 7; d) start the applicator 19 and polish the surface; and e) wipe off any excess polishing composition with a cloth having the same material as the cover 7. As stated, an orbiter 1 is used because it is readily available. Further these already have the means for attaching a pad assembly. Applicant has not found a commercially available applicator device that have short and sharp vibration motion only for use with the polishing composition but it does not necessarily mean that it is not existing. Commercially available orbiter 1 is actually a compromise since the rotating action of the orbiter 1 is not required. The orbiter is usually set at a high speed to achieve the degree of vibration that will allow the polishing composition to penetrate into the scratches. Since the speed rating is variable for every orbiter 1, the setting can be determined easily by a simple pretest of polishing a certain area of the surface.

While the embodiments of the present invention have been described, it should be understood that various changes, adaptations, and modifications may be made therein without departing from the spirit of the invention and the scope of the claims.

We claim:

1. A surface polishing system leaving a surface free from streaks and swirls after application, comprising:

a polish applicator having a vibrating motion attached to a pad assembly covered with a supersoft 100% polyester material, the pad assembly comprising a pad and a means to attach the pad to the applicator; and, a polishing composition of 15-30% by weight of high purity aluminum oxide having a particle size of no greater than 0.3 micron or 300 nanometer and 3-20% by weight of calcined alumina comprising at least 70% a-aluminum oxide (Al2O3) with a low calcination degree and a primary crystal size of less than 1 micron, the combined high purity aluminum oxide and calcined alumina having a total concentration of 30-40% by weight of the polishing composition.

2. The surface polishing system of claim 1 wherein the pad assembly comprises of a non-water and non-reactive absorbent pad for water based polishing compositions.

3. The surface polishing system of claim 1 wherein the pad assembly comprises of a pad that is non-reactive, non-absorbent and not soluble for polishing compositions that are organic solvent based.

4. The surface polishing system of claim 1 wherein the supersoft 100% polyester cover is a removable sleeve.

5. The surface polishing system of claim 1 wherein an entire inner surface of the supersoft 100% polyester cover is entirely attached to one side of the pad assembly, the side facing the inner surface of the cover.

6. The surface polishing system of claim 1 wherein the supersoft 100% polyester cover is lined with a plastic frame.

7. The surface polishing system of claim 1 wherein the supersoft 100% polyester comprises a pile of packed fine supersoft fibrous filaments having a thickness of approximately 0.00013 to 0.0003 inches and a length of approximately 0.1 to 0.16 inches.

8. The surface polishing system of claim 1 wherein the polishing composition is a water based composition further comprising a suspending agent, a silicone emulsion, a gloss enhancing agent, a hydrocarbon solvent and water.

9. The surface polishing system of claim 8 wherein the suspending agent is a hydroxypropyl methylcellulose product, the silicone emulsion is an emulsified silicone oil comprising 60% active non-ionic emulsion formulated with a polydimethylsiloxane, the gloss enhancing agent consisting of linear non-reactive polydimethylsiloxane, and the hydrocarbon solvent is an aliphatic hydrocarbon.

10. The surface polishing system of claim 9 wherein the hydroxypropyl methylcellulose suspending agent is 0.2-1%, the polydimethylsiloxane silicone emulsion is 5-30%, the linear non-reactive polydimethylsiloxane gloss enhancing agent is 1-8%, and the aliphatic hydrocarbon solvent is 5-10%.

11. The surface polishing system of claim 8 further comprising preservatives, fragrances and colorants in effective amounts of less than 1%.

12. The surface polishing system of claim 8 further comprising a wax emulsion, a water repellent film former and an additional gloss agent.

13. The surface polishing system of claim 12 wherein the wax emulsion is 2-15%, the water repellent film former is 0.5 to 5%, and the additional gloss agent is 0.1 to 1%.

14. A surface polishing system leaving a surface free from streaks and swirls after application, comprising:

a polish applicator having a vibrating motion attached to a pad assembly covered with a supersoft 100% polyester material comprising a pile of packed fine supersoft fibrous filaments having a thickness of approximately 0.00013 to 0.0003 inches and a length of approximately 0.1 to 0.16 inches, the pad assembly comprising a non-reactive, non-absorbent and non-soluble pad attached to the applicator; and, a polishing composition comprising 15-30% by weight of high purity aluminum oxide having a particle size of no greater than 0.3 micron or 300 nanometer, 3-20% by weight of calcined alumina comprising at least 70% α-aluminum oxide (Al2O3) with a low calcination degree and a primary crystal size of less than 1 micron, the combined high purity aluminum oxide and calcined alumina having a total concentration of 30-40% by weight of the polishing composition, a suspending agent, a silicone emulsion, a gloss enhancing agent, a hydrocarbon solvent and water.

15. The surface polishing system of claim 14 wherein the suspending agent is a hydroxypropyl methylcellulose product at a concentration of 0.2-1%, the silicone emulsion is an emulsified silicone oil comprising 60% active non-ionic emulsion formulated with a polydimethylsiloxane at a concentration of 5-300, the gloss enhancing agent consisting of linear non-reactive polydimethylsiloxane at a concentration of 1-8%, and the hydrocarbon solvent is an aliphatic hydrocarbon at a concentration of 5-10%.

16. The surface polishing system of claim 14 further comprising a wax emulsion, a water repellent film former an additional gloss agent, preservatives, fragrances and colorants.

17. The surface polishing system of claim 16 wherein the wax emulsion is 2-15%, the water repellent film former is 0.5 to 5%, the additional gloss agent is 0.1 to 1% and the preservatives, fragrances and colorants are in effective amounts of less than 1%.

18. A polish applicator having a vibrating motion attached to a pad assembly covered with a supersoft 100% polyester material comprising a pile of packed fine supersoft fibrous filaments having a thickness of approximately 0.00013 to 0.0003 inches and a length of approximately 0.1 to 0.16 inches, the pad assembly comprising a non-reactive, non-absorbent and non-soluble pad attached to the applicator.

* * * * *